US008925277B2

(12) United States Patent
Cai et al.

(10) Patent No.: US 8,925,277 B2
(45) Date of Patent: Jan. 6, 2015

(54) COMPOSITE SELF SUPPORTING TOWER STRUCTURE

(71) Applicant: Glenmartin Holding Co., LLC, Columbia, MO (US)

(72) Inventors: Xinguo Cai, Jefferson City, MO (US); Christopher J Martin, Columbia, MO (US)

(73) Assignee: Glenmartin Holding Co, LLC, Boonville, MO (US)

( * ) Notice: Subject to any disclaimer, the term of this patent is extended or adjusted under 35 U.S.C. 154(b) by 0 days.

(21) Appl. No.: 14/079,182

(22) Filed: Nov. 13, 2013

(65) Prior Publication Data

US 2014/0130439 A1 May 15, 2014

Related U.S. Application Data

(60) Provisional application No. 61/725,699, filed on Nov. 13, 2012.

(51) Int. Cl.
*E04H 12/08* (2006.01)
*E04H 12/24* (2006.01)

(52) U.S. Cl.
USPC ..... 52/651.01; 52/655.1; 52/653.1; 52/655.2; 52/648.1

(58) Field of Classification Search
USPC ..... 52/651.01, 655.1, 655.2, 633–639, 52/648.1, 646, 653.1, 653.2, 654.1
See application file for complete search history.

(56) References Cited

U.S. PATENT DOCUMENTS

| | | | | |
|---|---|---|---|---|
| 4,460,288 | A * | 7/1984 | Schaff | 403/27 |
| 5,390,463 | A * | 2/1995 | Sollner | 52/650.2 |
| 5,526,614 | A * | 6/1996 | Huang | 52/13 |
| 5,704,185 | A * | 1/1998 | Lindsay | 52/655.1 |
| 6,745,539 | B1 | 6/2004 | Heim | |
| 8,534,024 | B2 * | 9/2013 | Messier | 52/637 |
| 2003/0172612 | A1 | 9/2003 | Simmons | |
| 2004/0154236 | A1 | 8/2004 | Kinzer | |
| 2010/0192506 | A1 * | 8/2010 | Allred et al. | 52/655.1 |
| 2011/0005161 | A1 | 1/2011 | Noble | |

FOREIGN PATENT DOCUMENTS

EP 2444571 4/2013

OTHER PUBLICATIONS

International Search Report, May 22, 2014, PCT/US2013/069888 filed Nov. 13, 2013, pp. 1-2.

* cited by examiner

*Primary Examiner* — Jeanette E. Chapman
(74) *Attorney, Agent, or Firm* — Dentons US LLC; Brian R. McGinley

(57) ABSTRACT

A tower having a lattice structure for improved structural reliability and load bearing.

27 Claims, 4 Drawing Sheets

COMPOSITE SELF SUPPORTING TOWER STRUCTURE

CROSS-REFERENCE TO RELATED APPLICATION

This Patent Application claims priority to U.S. Provisional Patent Application Ser. No. 61/725,699 titled Composite Self Supporting Tower Structure, and filed Nov. 13, 2012, the contents of which is incorporated herein by reference in its entirety.

BACKGROUND

1. Field

The present general inventive concept relates to a load-bearing tower, and more particularly to a new tower designed around a lattice structure for improved structural reliability and load bearing.

2. Discussion of Related Art

Existing towers utilize a lattice member for supporting the primary load transfer in the tower structure. However, the lattice member structure and other components of existing towers have poor adaptability by virtue of their construction, and generally lack the structural reliability of the tower according to the inventive concept disclosed herein.

SUMMARY

The following brief description is provided to indicate the nature of the subject matter disclosed herein. While certain aspects of the present inventive concept are described below, the summary is not intended to limit the scope of the present inventive concept.

The present general inventive concept provides a tower having a lattice structure for improved structural reliability and load bearing. The present inventive concept provides, in its simplest form, a tower with a plurality of equidistant legs having various assemblies attached thereto to increase the structural reliability and load bearing qualities of the tower.

The aforementioned aspects may be achieved in one aspect of the present inventive concept by providing a tower leg having an elongated base plate, an elongated rod, and a receiver. The elongated base plate may have opposing front and rear surfaces, and/or a perimeter edge extending along either side of the front and rear surfaces. The elongated rod may extend parallel to each of the edges of the base plate. Each of the elongated rods may be affixed to one of the edges of the base plate. The receiver may extend from each of the elongated rods.

Each of the elongated rods may at least partially include a circumferential surface. Each of the receivers may extend from one of the circumferential surfaces of the elongated rods at a predetermined angle relative to a plane defined by the base plate. Each of the receivers may be configured to receive a support element. The predetermined angle may be 30 degrees and/or 45 degrees.

The support element may be a cross brace configured to secure the tower leg to another tower leg of a tower. Each receiver may be positioned adjacent to at least one other of the receivers to form a pair of receivers. Each receiver of the pair of receivers may extend from a different elongated rod. Each receiver of the pair of receivers may extend from the different elongated rods at inverse angles relative to each other. Each receiver of the pair of receivers may extend from the different elongated rods at a same angle relative to a plane defined by the base plate. The pair of receivers may extend from the different elongated rods at a predetermined angle relative to each other. The predefined angle may be 45 degrees and/or 60 degrees.

The tower leg may further include a face plate arrangement secured to the front surface of the base plate. The face plate arrangement may include opposing lateral plates secured together and/or to the base plate via a plurality of connectors. The opposing lateral plates may be "L" shaped and may be spaced from each other by a plurality of spacers.

The tower leg may further include a rear plate arrangement secured to the rear surface of the base plate. The rear plate arrangement may include opposing lateral plates secured together and/or to the base plate via a plurality of connectors. The opposing lateral plates may be "L" shaped and spaced from each other by a plurality of spacers.

The aforementioned aspects may be achieved in one aspect of the present inventive concept by providing a tower having a plurality of legs and a plurality of cross braces. Each leg may include an elongated base plate, an elongated rod, and a receiver. The elongated base plate may have (i) opposing front and rear surfaces, and/or (ii) a perimeter edge extending along either side of the front and rear surfaces. The elongated rod may extend parallel to each of the edges of the base plate. Each of the elongated rods may be affixed to one of the edges of the base plate. The receiver may extend from each of the elongated rods. Each of the cross braces may be affixed to at least two of the plurality of legs via the receiver of each of the at least two of the plurality of legs.

Each of the elongated rods may include a surface that is at least partially curved or circumferential. Each of the receivers may extend from one of the circumferential surfaces of the elongated rods at a predetermined angle relative to a plane defined by the base plate. The predetermined angle may be 30 degrees or 45 degrees.

Each receiver may be positioned adjacent to at least one other of the receivers to form a pair of receivers. Each receiver of the pair of receivers may extend from a different elongated rod. Each receiver of the pair of receivers may extend from the different elongated rods at inverse angles relative to each other. Each receiver of the pair of receivers may extend from the different elongated rods at a same angle relative to a plane defined by the base plate. The pair of receivers may extend from the different elongated rods at a predetermined angle relative to each other. The predefined angle is 45 degrees or 60 degrees.

The tower may further include a face plate arrangement secured to the front surface of the base plate. The face plate arrangement may include opposing lateral plates secured together and/or to the base plate via a plurality of connectors. The opposing lateral plates may be "L" shaped and/or spaced from each other by a plurality of spacers.

The tower may further include a rear plate arrangement secured to the rear surface of the base plate. The rear plate arrangement may include opposing lateral plates secured together via a plurality of connectors. The opposing lateral plates may be "L" shaped and/or spaced from each other by a plurality of spacers.

The aforementioned aspects may be achieved in one aspect of the present inventive concept by providing a method of assembling a tower leg. The method may include the steps of securing a face plate arrangement to a front surface of an elongated base plate and securing a rear plate arrangement to the rear surface of the elongated base plate. The base plate may have (i) a rear surface that opposes the front surface, and/or (ii) a circumferential edge extending along both sides of the front and rear surfaces. At least one receiver may extend from each of the circumferential edges.

The aforementioned aspects may be achieved in one aspect of the present inventive concept by providing a method of assembling a tower. The method may include the step of securing a plurality of legs to each other. Each leg may include (a) an elongated base plate having (i) opposing front and rear surfaces, and (ii) a perimeter edge extending along either side of the front and rear surfaces, (b) an elongated rod extending parallel to each of the edges of the base plate, each of the elongated rods affixed to one of the edges of the base plate, and/or (c) a receiver extending from each of the elongated rods. The legs may be secured to each other via at least one cross brace affixed to at least two of the plurality of legs via the receiver of each of the at least two of the plurality of legs.

Additional aspects, advantages, and utilities of the present inventive concept will be set forth in part in the description which follows and, in part, will be obvious from the description, or may be learned by practice of the present inventive concept.

BRIEF DESCRIPTION OF THE DRAWINGS

Embodiments of the present inventive concept are described herein with reference to the following drawing figures, wherein.

DETAILED DESCRIPTION

The following detailed description of the present inventive concept references the accompanying drawings that illustrate specific examples of the present inventive concept. The examples are intended to describe aspects of the present inventive concept in sufficient detail to enable those skilled in the art to practice the present inventive concept. Other combinations of, variations on, and relationships between the elements disclosed may be utilized without departing from the scope of the present inventive concept. The following detailed description is, therefore, not to be taken in a limiting sense. The scope of the present inventive concept is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
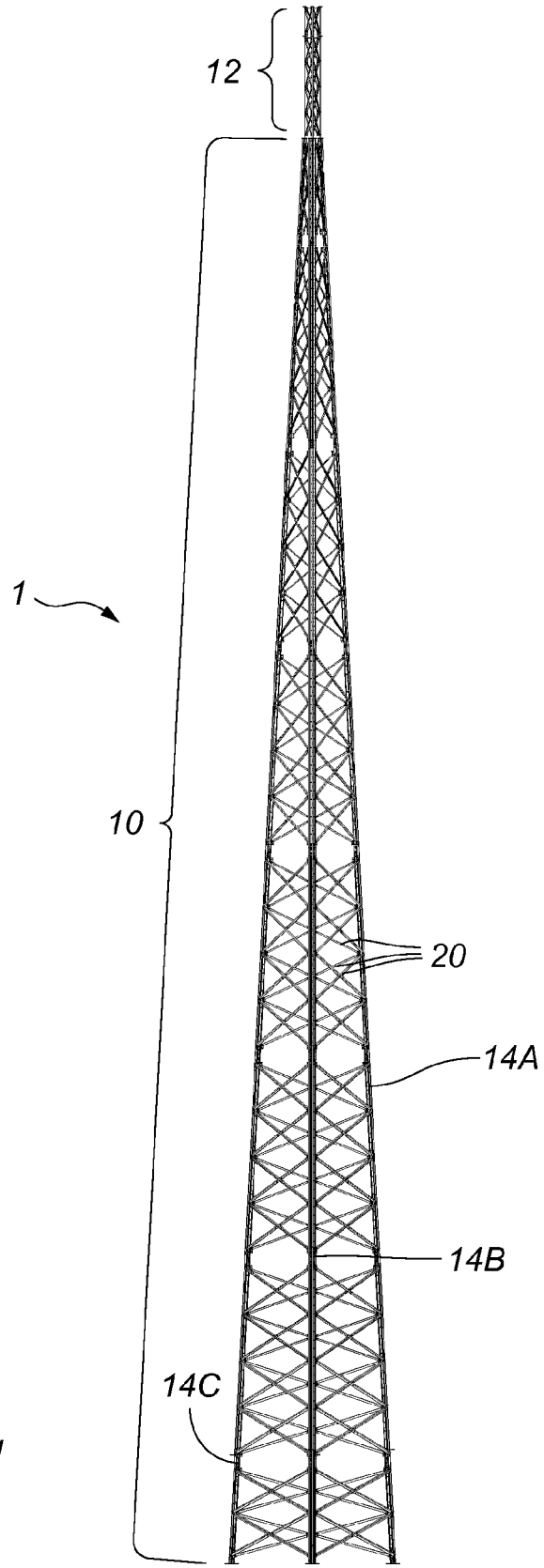
FIG. 1 is a perspective view of a tower in accordance with an exemplary embodiment of the present inventive concept.

Turning to the drawings and particularly FIG. 1, a load-bearing tower 1 according to the present inventive concept is illustrated. The tower 1 includes a lower tower structure 10, which forms a base or primary structure of the tower 1, and an upper tower structure 12, which is assembled on top of and securely attached directly to the lower tower structure 10. In this embodiment, the tower 1 includes three legs 14A, 14B, 14C that vertically extend along an entirety of the tower 1 including the lower and upper tower structures 10, 12. However, it is foreseen that the tower 1 may include additional legs, with each leg in an equidistant configuration with respect to its neighbouring legs, without departing from the spirit of the present inventive concept.

Figure 2:
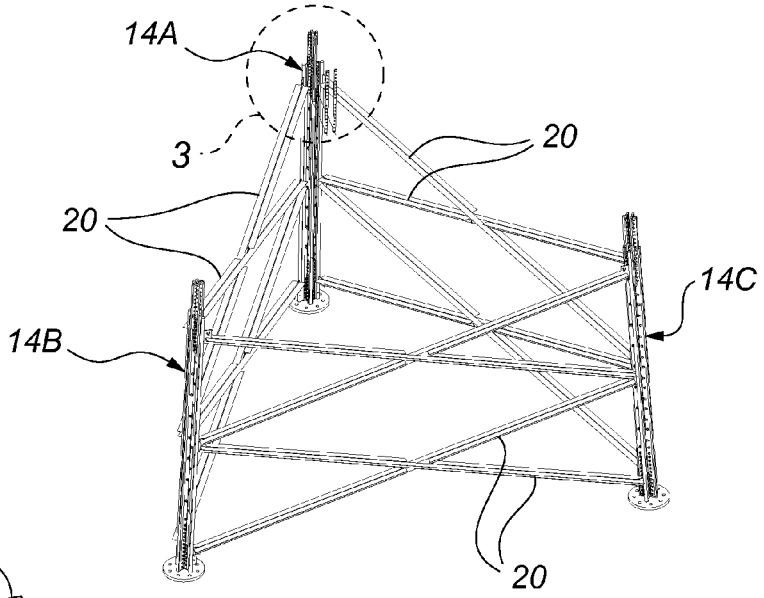
FIG. 2 is a magnified perspective view of a bottom section of the tower illustrated in FIG. 1.
Figure 3:
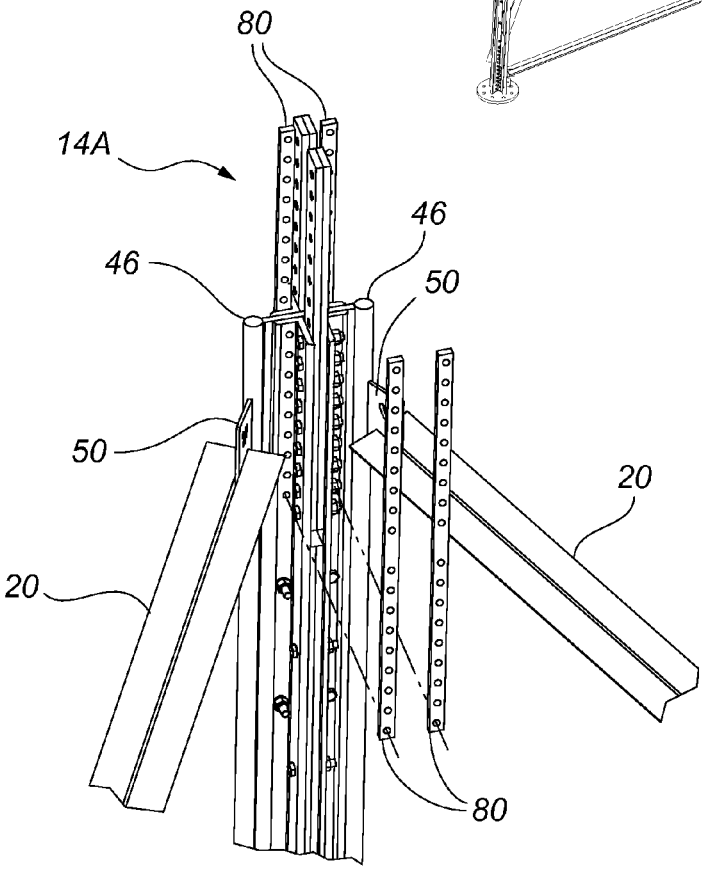
FIG. 3 is another magnified perspective view of the bottom section of the tower illustrated in FIG. 1.
Figure 4:
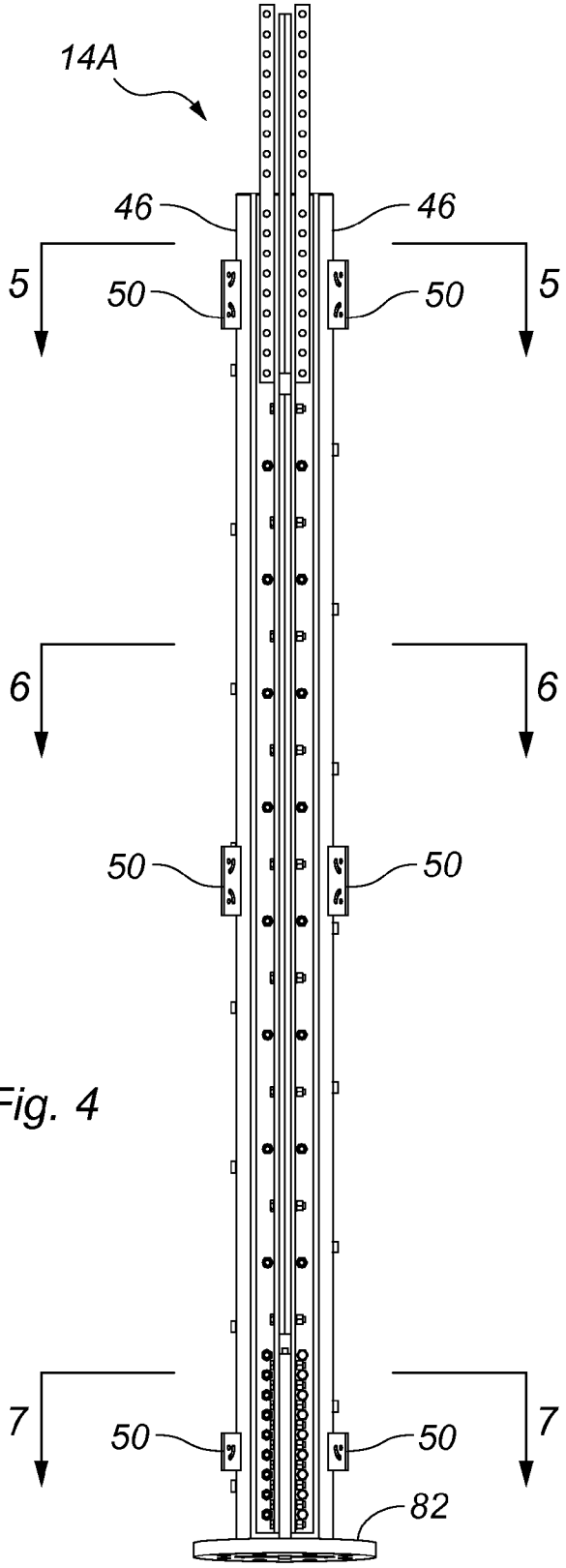
FIG. 4 is a side elevation view of a leg of the tower illustrated in FIG. 1.

As illustrated in FIGS. 1 and 2, the legs 14A, 14B, 14C are connected to adjacent ones of the legs 14A, 14B, 14C by lateral-support elements or cross braces 20. Each of the cross braces 20 connects two of the legs 14A, 14B, 14C by extending from a first one of the legs 14A, 14B, 14C at an acute angle (for example, sixty degrees) toward a second one of the legs 14A, 14B, 14C, thereby crossing another of the cross braces 20 about halfway between the two of the legs 14A, 14B, 14C, and continuing toward and fixing to the second one of the legs 14A, 14B, 14C. The another of the cross braces 20 is similarly affixed to the two legs 14A, 14B, 14C, and extends from the second one of the legs 14A, 14B, 14C toward the first one of the legs 14A, 14B, 14C to form a cross with the cross brace 20. In the embodiment depicted in FIGS. 1 and 2, the primary tower structure 10 is divided vertically into sections, with each section having a repeating pattern of cross braces 20, and with a break in that pattern between sections. Most of the depicted vertically-stacked sections are approximately the same height. It is foreseen that different cross brace patterns may be employed without departing from the scope of the present inventive concept. It is further foreseen that the tower 1 may consist of fewer, and perhaps as few as one, vertical section(s), or of vertical sections having varying height, without departing from the scope of the present inventive concept.

Turning now to FIGS. 3-7, a section of leg 14A is illustrated. Each of the legs 14A, 14B, 14C are identical. Thus, although only leg 14A is described in further detail hereafter, it should be understood that legs 14B and 14C include each feature of leg 14A. The leg 14A includes an elongated base plate 30 having opposing front and rear surfaces 32, 34, and common perimeter edges 36, 38 on either side of the front and rear surfaces 32, 34. An elongated rod 46 extends parallel to each of the edges 36, 36 of the base plate 30. In the exemplary embodiment, there are two rods 46, with each rod 46 affixed to one of the edges 36, 38 via welding, e.g., submerged arc welding, an adhesive, and/or the like. Thus, each edge 36, 38 includes one of the rods 46 extending therealong. It is foreseen, however, that any number of rods 46 may be included without deviating from the scope of the present inventive concept. It is also foreseen that the rods 46 may be made integral to or formed with the base plate 30 so that the rods 46 are merely thicker portions of the base plate 30 forming circumferential edges without deviating from the scope of the present inventive concept.

Figure 5:
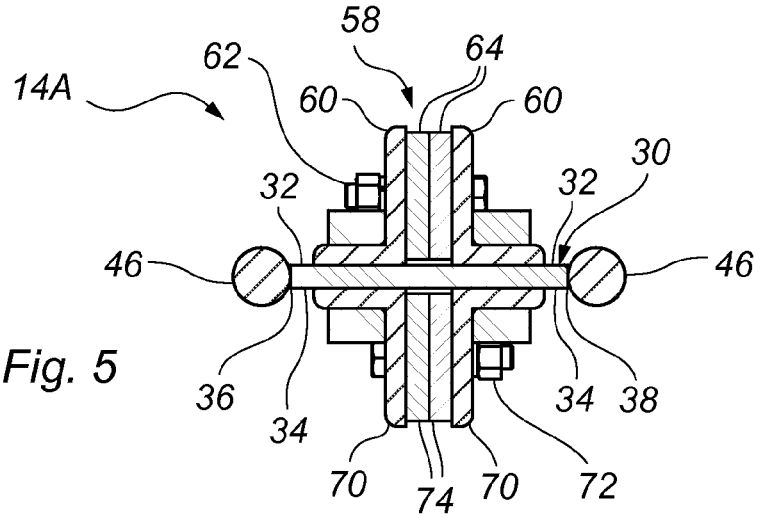
FIG. 5 is a cross-section view of the leg of the tower illustrated in FIG. 4 taken along 5-5 showing a cross-section of a dog-bone feature of the leg.
Figure 6:
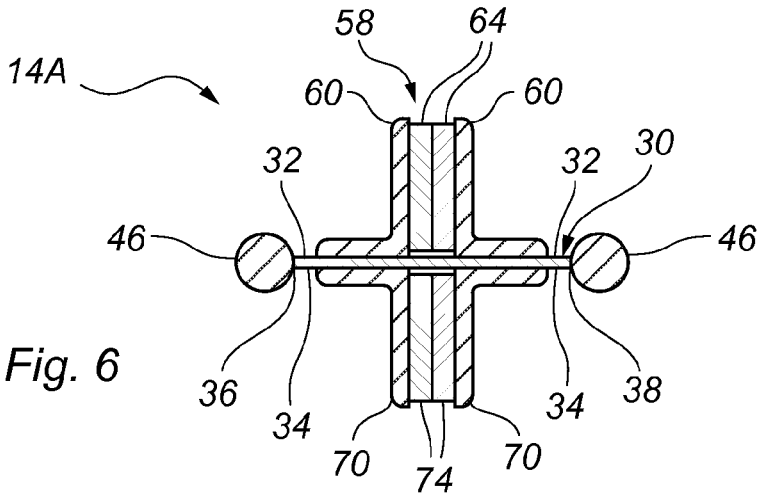
FIG. 6 is a cross-section view of the leg of the tower illustrated in FIG. 4 taken along 6-6 showing a cross-section of a dog-bone feature of the leg.
Figure 7:
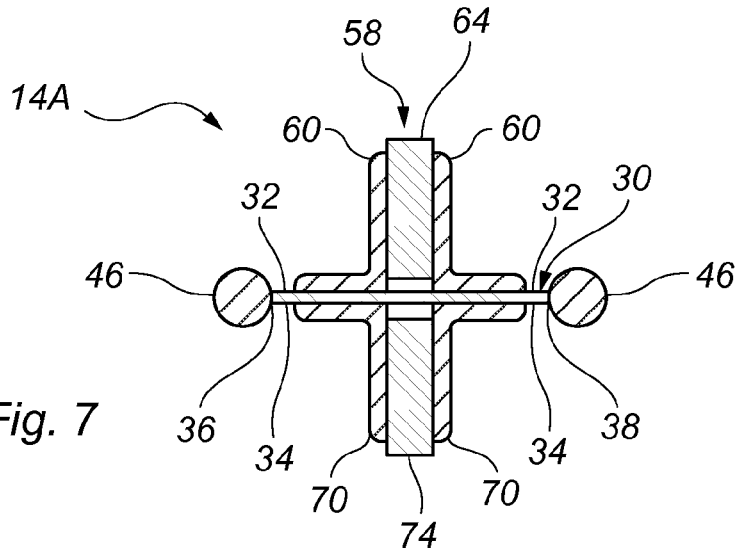
FIG. 7 is a cross-section view of the leg of the tower illustrated in FIG. 4 taken along 7-7 showing a cross-section of a dog-bone feature of the leg.

The rods 46 are identically-sized and shaped, and have a curved or circumferential outer surface that, in combination with the base plate 30, forms a "dog bone" shape, as illustrated in FIGS. 5-7. Each of the rods 46 have a plurality of tabs or receivers 50 extending therefrom and attached thereto via welding, e.g., gas metal arc welding, an adhesive, and/or the like. Each of the receivers 50 are identically sized and shaped to securely receive one of the cross braces 20 via a curved slot. Each of the receivers 50 extends from the circumferential outer surface of the rods 46 at a predetermined angle based on the number of legs 14A, 14B, 14C included in the tower 1. If the tower 1 includes three legs, i.e., legs 14A, 14B, 14C, the receivers 50 extend from the circumferential outer surface of the rods 46 at thirty degrees relative to a plane defined by the front surface 30 and/or the rear surface 32 of the base plate 30. Alternatively, if the tower 1 includes four legs, the receivers 50 extend from the circumferential outer surface of the rods 46 at forty-five degrees relative to the plane defined by the front surface 30 and/or the rear surface 32 of the base plate 30. It is foreseen, however, that the tower 1 is not limited to either three or four legs, but may include any number of legs in an equidistant and/or non-equidistant relationship to each other with receivers 50 arranged to accommodate the legs without deviating from the scope of the present inventive concept.

Each of the receivers 50 is positioned adjacent to another one of the receivers 50 to form a pair of receivers 50. Each receiver 50 of the pair of receivers 50 extends from different ones of the elongated rods 46 at a same angle relative to a plane defined by the base plate 30, such as but not limited to thirty degrees, or forty-five degrees. In this manner, each receiver 50 of the pair of receivers 50 extends from the different elongated rods 46 at angles that are inverse to each other, such as but not limited to thirty degrees and negative thirty degrees, respectively, or forty-five degrees and negative forty-five degrees, respectively. Also, the combined angle of each pair of the receivers 50 is sixty degrees or ninety degrees.

The base plate 30 includes a face plate arrangement 58 secured to the front surface 32 of the base plate 30. The face plate arrangement 58 includes opposing lateral plates 60 secured together and/or to the front surface 32 of the base plate 30 via a plurality of connectors 62. The connectors 62 may be any means for connection, but in the present embodiment are nut and bolt connectors. It is foreseen, however, that the connectors 62 may be omitted from the present inventive concept, with the lateral plates 60 secured together via welding, an adhesive, and/or the like without deviating from the scope of the present inventive concept.

The base plate 30 also includes a rear plate arrangement 68 secured to the rear surface 34 of the base plate 30. The face plate arrangement 68 includes opposing lateral plates 70 secured together and/or to the rear surface 34 of the base plate 30 via a plurality of connectors 72. The connectors 72 may be any means for connection, but in the present embodiment are nut and bolt connectors. It is foreseen, however, that the connectors 72 may be omitted from the present inventive concept, with the lateral plates 70 secured together via welding, an adhesive, and/or the like without deviating from the scope of the present inventive concept.

Each of the lateral plates 60, 70 are "L" shaped and entirely spaced from each other by at least one spacer 64, 74, respectively. Each of the spacers 64, 74 are spaced from the base plate 30, but may abut base plate 30 without deviating from the scope of the present inventive concept. Each of the spacers 64, 74, in combination with the rods 46, advantageously increase the structural integrity of the base plate 30 and ultimately the structural integrity of the tower 1.

The leg 14A includes a plurality of base plates connected together using base-plate connectors 80 that extend between the plurality of base plates. Specifically, each base-plate connectors 80 is secured to the lateral plates 60, 70 of each base plate 30 via attachment means, e.g., a nut and bolt assembly or the like. At a lower end of the base plate 30 is an abutment surface 82 that is sized and shaped to be secured to a concrete pad or the like via attachment means, e.g., a nut and bolt assembly or the like.

In this manner, the present inventive concept provides the tower 1 having a lattice structure for improved structural reliability and load bearing.

The preferred forms of the invention described above are to be used as illustration only, and should not be used in a limiting sense to interpret the scope of the present inventive concept. Modifications to the exemplary embodiments, set forth above, could be readily made by those skilled in the art without departing from the spirit of the present inventive concept.

The inventors hereby state their intent to rely on the Doctrine of Equivalents to determine and assess the reasonably fair scope of the present inventive concept as it pertains to any apparatus not materially departing from but outside the literal scope of the invention as set forth in the following claims.

The invention claimed is:

1. A tower leg defining a height extending along a longitudinal axis of the tower leg, and a width extending along a transverse axis of the tower leg orthogonal in relation to the longitudinal axis, the height of the tower leg being greater than the width of the tower leg, the tower leg comprising:

an elongated base plate having (i) opposing front and rear surfaces, and (ii) a perimeter edge extending along either side of the front and rear surfaces, the elongate base plate defining a length extending parallel in relation to the height of the tower leg, and a depth extending parallel in relation to the width of the tower leg, the length of the elongate base plate being greater than the width of the elongate base plate;

an elongated rod extending parallel to each of the edges of the base plate, each of the elongated rods affixed to one of the edges of the base plate; and a receiver extending from each of the elongated rods.

2. The tower leg according to claim 1, wherein each of the elongated rods includes a circumferential surface; and each of the receivers (i) extend from one of the circumferential surfaces of the elongated rods at a predetermined angle relative to a plane defined by the base plate, and (ii) are configured to receive a support element.

3. The tower leg according to claim 2, wherein the predetermined angle is 30 degrees or 45 degrees.

4. The tower leg according to claim 2, wherein the support element is a cross brace configured to secure the tower leg to another tower leg of a tower.

5. The tower leg according to claim 2, wherein each receiver is positioned adjacent to at least one other of the receivers to form a pair of receivers.

6. The tower leg according to claim 5, wherein each receiver of the pair of receivers extends from a different elongated rod.

7. The tower leg according to claim 6, wherein each receiver of the pair of receivers extends from the different elongated rods at inverse angles relative to each other.

8. The tower leg according to claim 6, wherein each receiver of the pair of receivers extends from the different elongated rods at a same angle relative to a plane defined by the base plate.

9. The tower leg according to claim 5, wherein the pair of receivers extends from the different elongated rods at a predetermined angle relative to each other; and the predetermined angle is 45 degrees or 60 degrees.

10. The tower leg according to claim 1, further comprising: a face plate arrangement secured to the front surface of the base plate, the face plate arrangement including opposing lateral plates secured together and to the base plate via a plurality of connectors.

11. The tower leg according to claim 10, wherein the opposing lateral plates are "L" shaped and spaced from each other by a plurality of spacers.

12. The tower leg according to claim 1, further comprising: a rear plate arrangement secured to the rear surface of the base plate, the rear plate arrangement including opposing lateral plates secured together and to the base plate via a plurality of connectors.

13. The tower leg according to claim 12, wherein the opposing lateral plates are "L" shaped and spaced from each other by a plurality of spacers.

14. A tower comprising:

a plurality of legs, each leg defining a height extending along a longitudinal axis of the leg, and a width extending along a transverse axis of the leg orthogonal in relation to the longitudinal axis, the height of the leg being greater than the width of the leg, each leg including, (a) an elongated base plate having (i) opposing front and rear surfaces, and (ii) a perimeter edge extending along either side of the front and rear surfaces, the elongate base plate defining a length extending parallel in relation to the height of the leg, and a depth extending parallel in relation to the width of the leg, the length of the elongate base plate being greater than the width of the elongate base plate;

(b) an elongated rod extending parallel to each of the edges of the base plate, each of the elongated rods affixed to one of the edges of the base plate, and (c) a receiver extending from each of the elongated rods; and a plurality of cross braces, each affixed to at least two of the plurality of legs via the receiver of each of the at least two of the plurality of legs.

15. The tower according to claim 14, wherein each of the elongated rods includes a circumferential surface; and each of the receivers extend from one of the circumferential surfaces of the elongated rods at a predetermined angle relative to a plane defined by the base plate.

16. The tower according to claim 15, wherein the predetermined angle is 30 degrees or 45 degrees.

17. The tower according to claim 15, wherein each receiver is positioned adjacent to at least one other of the receivers to form a pair of receivers.

18. The tower according to claim 17, wherein each receiver of the pair of receivers extends from a different elongated rod.

19. The tower according to claim 18, wherein each receiver of the pair of receivers extends from the different elongated rods at inverse angles relative to each other.

20. The tower according to claim 18, wherein each receiver of the pair of receivers extends from the different elongated rods at a same angle relative to a plane defined by the base plate.

21. The tower according to claim 17, wherein the pair of receivers extends from the different elongated rods at a predetermined angle relative to each other; and the predetermined angle is 45 degrees or 60 degrees.

22. The tower according to claim 13, further comprising: a face plate arrangement secured to the front surface of the base plate, the face plate arrangement including opposing lateral plates secured together and to the base plate via a plurality of connectors.

23. The tower according to claim 22, wherein the opposing lateral plates are "L" shaped and spaced from each other by a plurality of spacers.

24. The tower according to claim 14, further comprising: a rear plate arrangement secured to the rear surface of the base plate, the rear plate arrangement including opposing lateral plates secured together via a plurality of connectors.

25. The tower according to claim 24, wherein the opposing lateral plates are "L" shaped and spaced from each other by a plurality of spacers.

26. A method of assembling a tower leg defining a height extending along a longitudinal axis of the leg, and a width extending along a transverse axis of the leg orthogonal in relation to the longitudinal axis, the height of the leg being greater than the width of the leg, the method comprising the steps of:

securing a face plate arrangement to a front surface of an elongated base plate, the face plate defining planar inner surfaces, the base plate having (i) a rear surface that opposes the front surface, and (ii) a circumferential edge extending along both sides of the front and rear surfaces, the elongate base plate defining a length extending parallel in relation to a height of the tower leg, and a depth extending parallel in relation to a width of the tower leg, the length of the elongate base plate being greater than the width of the elongate base plate; and securing a rear plate arrangement to the rear surface of the elongated base plate, wherein, at least one receiver extends from each of the circumferential edges.

27. A method of assembling a tower, the method comprising the step of:

securing a plurality of legs to each other, each leg defining a height extending along a longitudinal axis of the leg, and a width extending along a transverse axis of the leg orthogonal in relation to the longitudinal axis, the height of the leg being greater than the width of the leg, each leg including, (a) an elongated base plate having (i) opposing front and rear surfaces, and (ii) a perimeter edge extending along either side of the front and rear surfaces, the elongate base plate defining a length extending parallel in relation to a height of the tower leg, and a depth extending parallel in relation to a width of the tower leg, the length of the elongate base plate being greater than the width of the elongate base plate, (b) an elongated rod extending parallel to each of the edges of the base plate, each of the elongated rods affixed to one of the edges of the base plate, and (c) a receiver extending from each of the elongated rods, wherein, the legs are secured to each other via at least one cross brace affixed to at least two of the plurality of legs via the receiver of each of the at least two of the plurality of legs.

* * * * *